United States Patent [19]

Levine

[11] Patent Number: 4,548,510

[45] Date of Patent: Oct. 22, 1985

[54] SELECTIVE TIME SCHEDULER AND SUBSCHEDULER

[76] Inventor: Alfred B. Levine, P.O. Box 9516, Washington, D.C. 20016

[21] Appl. No.: 568,359

[22] Filed: Jan. 5, 1984

[51] Int. Cl.[4] ..... G04B 47/00; G04B 19/24

[52] U.S. Cl. ..... 368/10; 368/28; 368/41; 368/72

[58] Field of Search ..... 368/10.28–10.30, 368/41–44, 82–84, 239 S, 241, 242; 340/756–757, 798–799; 364/569, 200, 900

[56] References Cited

U.S. PATENT DOCUMENTS

| | | | |
|---|---|---|---|
| 3,999,050 | 12/1976 | Pitroda | 364/900 |
| 4,060,848 | 11/1971 | Hyatt | 364/200 |
| 4,162,610 | 7/1979 | Levine | 368/10 |
| 4,228,470 | 10/1980 | Rahamin et al. | 360/4 |
| 4,303,995 | 12/1981 | Aizawa | 368/28 |

*Primary Examiner*—Vit W. Miska

[57] ABSTRACT

An electronic time scheduler for entering and storing in a memory a plurality of daily schedules of events and appointments, and selectively reading out the daily schedule for any day or any daily subschedule of different times-of-day when no events or appointments have been previously made, or reading out both the daily schedule and subschedule together. Communicating of the schedules or subschedules that are read out can be by any one or more of a visual display on a screen, a printed record, or an audible annunciation. Where both the daily schedule and subschedule are read out together, either can be distinguished from the other by visually flashing or matrixing the displays, or even if one or the other of the schedule or subschedule is read out alone, it can be emphasized by a flashing display or a matrix of dots or otherwise to better attract the user's attention.

19 Claims, 6 Drawing Figures

10:45 AM
NO 11 AM
NO 11:15 AM
11:30 AM
NO 11:30 AM
12:00 PM
12:15 PM

NO 11:00 AM
NO 11:15 AM
NO 11:35 AM

10:45 AM
11:30 AM
12:00 PM
12:15 PM

SELECTIVE TIME SCHEDULER AND SUBSCHEDULER

BACKGROUND

In early U.S. Pat. No. 4,162,610, there is provided an electronic diary and time scheduler, permitting a user to enter at will into an electronic memory an entire schedule of daily events and appointments for a number of different days, and to selectively recall from the memory and display the daily schedule for any of the desired days. A system is also provided for communication between a plurality of such diaries and a central data processor or scheduler to transfer time schedule information therebetween.

In later application Ser. No. 566,312, filed Dec. 28, 1983, the information retrieved from memory is expanded to also include subschedules from any selected day, or other period, to convey or communicate to the user a series of different times-of-day, for a selected time interval when no events or appointments have been previously made, permitting the user to promptly ascertain those times that are still available for appointment or use, in order to efficiently utilize his time. Additionally, this later application also provides for serially reading out the schedule of appointments and no-appointments in chronological order regardless of the random manner of entry. Still further the later application also provides a printer for supplying a printed record of any selected schedule or subschedule, or both, that can be used instead of the visual display on a screen, if desired, or can be used along with the visual display to provide a permanent record.

SUMMARY OF THE INVENTION

According to the present invention, there is provided still additional features and advantages that are useful in an electronic diary or time scheduler. Among others, the invention provides for separately reading-out the daily schedule of appointments without also reading-out the subschedule of no-appointments made. Alternatively it provides for reading out the subschedule along without the schedule, or both as in the prior application. This separation of schedule and subschedule in the read-out enables the user to more easily determine his previous committments or the list of available times-of-day that have not yet been committed. Still further the present invention provides an audible enunciator for announcing either the selected schedule or subschedule, or both, if desired. A printed record or visual display on the screen can also be made alternatively, or together with the audible announcement. Thus the user can choose to have a rapid audible message announcing the subschedule of available appointment times for any given day or other period, or announcing the schedule of previously made appointments, or both; as well as a visual display or either or both, and/or a print-out record of either or both. All of these varying forms of and alternative modes of communication are very useful to the user and to others who wish to make appointments for a particular day and time, or to efficiently schedule the users time as well as the needs of the business or profession.

As a still further option, according to the present invention, the user can choose to have any selected one of the schedules or subschedules, or both, communicated in the form of a flashing display, or a matrix display, or in different color, or in some other special and distinctive form, to assist in distinguishing that schedule or subschedule, from another; or to merely assist in calling attention to the information communicated.

DETAILED DESCRIPTION OF PREFERRED EMBODIMENTS

Figure 1:
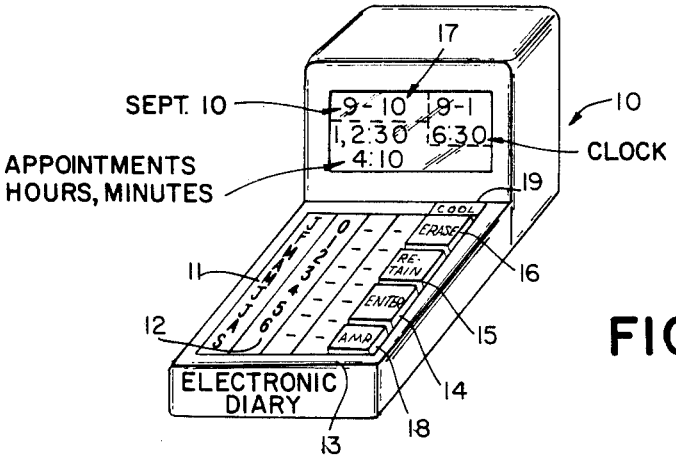
FIG. 1 is a perspective view, diagramatically illustrating the appearance of an appointment scheduler, as shown in the earlier patent and application.

Referring to FIG. 1, there is shown an electronic time scheduler, as disclosed in said patent and earlier application, having a keyboard with rows of keys such as 13 for manual entry of appointments by month, day, and time-of-day; together with a key 15 for read-out and display, and a key 16 for erasing any previous entry into the memory. Additional keys, such as 19, may also be added as desired, to permit entry and storage of codes or messages, corresponding to the appointments or events, or designating the persons or places associated with the events or appointments. Above the keyboard is provided a panel or display screen 17 for visually displaying the schedule of appointments or a subschedule of various times-of-day when no appointments have been previously made, as will be further discussed below. These schedules and/or subschedules may be displayed for an entire day or for any greater or lesser time period desired. Also displayed in digital from is the present month, day, and time of day from an electronic clock, for the convenience of the user.

Figures 2, 3, 4, 5:
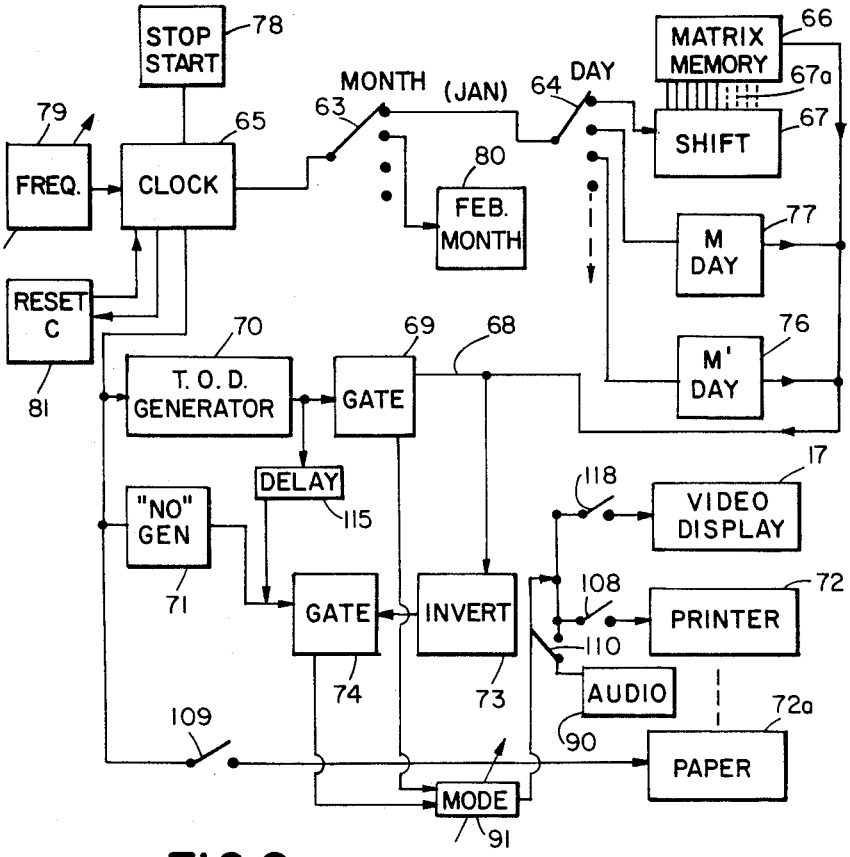
FIG. 2 is an electrical block diagram functionally illustrating in system configuration a preferred embodiment having selective modes of communicating the selected schedules or subschedules, or both.
FIGS. 3, 4, and 5 illustrate the display or print-out of the combined schedule and subschedule; the display or print-out of the subschedule alone; and the display or print-out of the schedule alone, respectively.

These schedules and/or subschedules may be displayed in the form of a table listing all of the appointments for the time period together as shown in FIGS. 3, 4, and 5; or alternatively, the appointments can be listed one-by-one in sequential order as disclosed in the earlier pending application above.

In operation, the user randomly enters into the keyboard the schedule of appointments for any future day, by depressing the enter key 14 followed by the month key 11, then the day key 12, then the time-of-day key 13, and finally the am or pm key 18. Where a message is to be entered for that time-of- day the user also enters the message through the keys for that purpose. As earlier described in the patent and earlier application, any one or more of the previously entered appointments may be changed or corrected or updated or erased at any later time by reading out the appointment to be changed and then operating the erase key 16, followed by reentering a new appointment, if any.

According to the present invention, the user is also provided with a number of additional selections and options. Initially the user can select to have the schedules communicated to him in a visual manner on the screen 17, as earlier described, or to have a printed record as disclosed in said prior application, or both. Still further the user can select to have an audible announcement of the schedule or subschedule, if desired, or obtain both an audible and visual form of communication. These options are shown in FIG. 2.

Figure 6:
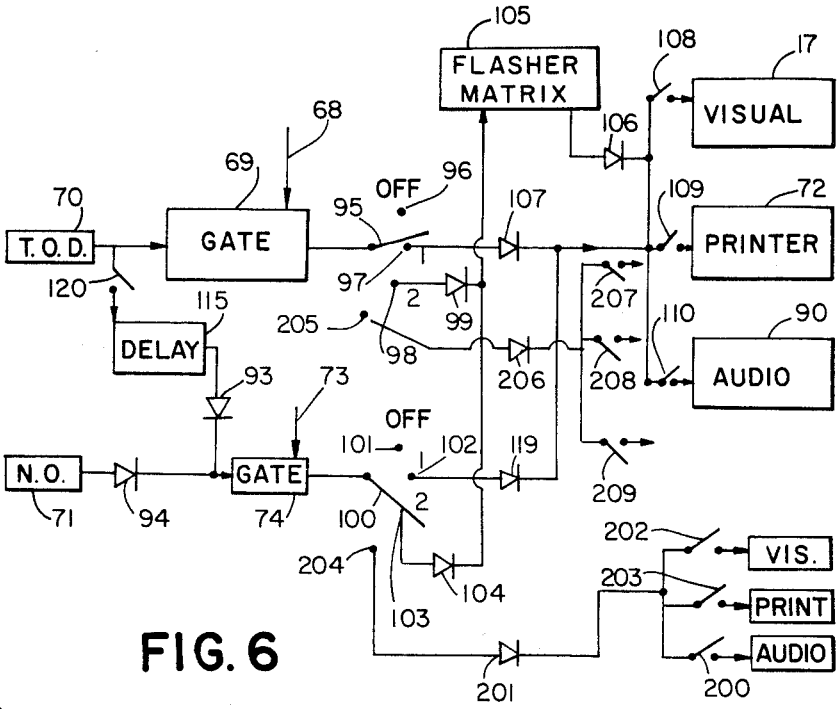
FIG. 6 is a functional block diagram illustrating the manner of distinguishing in the display or print-out the schedule or subschedule, or both, by a flashing display or other.

Still further according to the present invention, the user is provided with a choice of reading-out different types of information from the memory. For example, the user can choose to read-out the complete schedule of appointments that have been made for the desired interval as previously described. Alternatively, the user can choose to read-out for that interval only a subschedule of still available times-of-day when no appointments or events have been previously made. Or still further, the user can choose to have both the schedule and the subschedule for the period read out together. For any of these choices, the user can obtain the information by a visual display or print-out, or both, or by an audible announcement alone, or accompanied by the visual display or printed record. It is particularly useful to have an audible announcement of subschedule information where appointments are being made by telephone, or involving groups of people, all of whom may not have access to the visual screen 17 of FIG. 1, or the printed record. These various mode selections and choices are illustrated in FIG. 6.

Where a visual display or printout of the schedule and subschedule are made together, it is desired to distinguish the times-of-day in the schedule where appointments have already been made from the times-of-day in the subschedule when other times are still free and available for appointment. One manner of performing this function is disclosed in the earlier application above, by generating a fixed word in the display or printout, such as "NO" alongside each time of day when no appointment or event has been made. According to the present invention, additional ways of distinguishing the schedule from the subschedule are provided. Initially either the schedule or subschedule can be read-out by itself, or it may be read-out together with the other. Additionally, either or both of the read-outs can be provided in the form of a visually flashing display or print-out or in the form of a dot matrix, or even in different color, one from the other. Still a further manner of distinguishing one from the other is to read-out the schedule visually and the subschedule audibly, or the reverse. Thus the choices available to the user are quite flexible, enabling the user to obtain the desired form that is most convenient and useful for that particular user.

It will be appreciated by those skilled in the art that the electronic scheduler of the present invention may be combined with, or made part of, other electronic equipments, including calculators, computers, data processors, controls, communication equipments and others, and may accordingly share a common keyboard, common display, common print-out, and or common audible annunciator as well as sharing common amplifiers, and digital circuitry and micro chips. In such event, the user initiates operation of the appointment scheduler to enter or read-out schedules or/and subschedules by operating a further sequence of keys or switches (not shown) to initialize or condition the combined more versatile unit for this desired mode of operation.

FIG. 2 functionally illustrates a preferred system for reading out and communicating a schedule of appointments and/or a subschedule of times-of-day when no appointments have been made. As shown the system includes the keyboard operated switch 63 or switches for selecting the memory or portion of the memory concerning the "month", and the additional keyboard operated switch 64 for selecting the particular day of the month that is of interest. In FIG. 2, the month selected is shown as "January" by switch 63, and switch 64 is set as the first day of that month. Once the switches 63 and 64 are set (or the corresponding push button switches 11, 12, and 13 of FIG. 1), followed by depression of the start switch 78, an automatic chronological read-out of the memory 66 is performed, by pulsing a shift register by the clock 65, to successively read-out each position or location of the memory 66. Where an interrogated position indicates stored data, representative of an appointment having previously been made, an output pulse is produced over line 68 to close a gate 69. Gate 69 controls the read-out from the time-of-day generator 70, that produces a different time-of-day word each time it is pulsed by the clock 65. The T.O.D. generator 70 is synchronized with the interrogation of the memory 66, such that it generates a corresponding time-of-day word for each different time-of-day position of the memory 66. Thus where the memory position being interrogated contains a stored appointment, the corresponding time-of-day word produced by the generator 70 is read-out through the closed gate 69 and passed to the selectable mode control circuit 91. The mode control circuitry is shown in greater detail in FIG. 6, and will be described more fully below. It essentially enables the user to choose the manner of communicating the data or information being read out from the memory.

On the other hand, where a position of the memory 66 being interrogated does not indicate stored data, an inverter circuit 73 is operated by the output over line 68 to close a different gate 74. The closure of gate 74 passes a fixed word, such as "NO" or "OPEN" from a generator 71 to the adjustable mode control circuit 91 where this fixed word is read-out to the chosen mode of communication (video display and/or printer and/or audible) to inform the user that no appointments or events have been scheduled for that time-of-day. In addition to the fixed word "NO" being digitally passed by the closed gate 74, the time-of-day time slot is also passed through that gate 74 after being suitably time delayed by a delay circuit 115, as shown. Thus as each time slot of the memory 66 is chronologically interrogated by the clock pulses, the T.O.D. generator 70 reads-out a corresponding time-of-day signal in the event that an appointment has been made for that time slot. On the other hand where no appointment has been stored in memory, a fixed "NO" signal is read-out from generator 71, followed by a time delayed time-of-day signal.

FIG. 3 illustrates a video display or print-out of an examplary read-out from the memory 66 for a given day. As shown, for the first time slot an appointment is shown at "10:45 AM". However, the second time slot is shown to be free or available, since the display shows a "NO" followed by the time "11 AM". The third time slot at 11:15 AM is also shown as available, as is the fifth at 11:35 AM. However the fourth at 11:30 AM; the sixth at 12:00 PM; and the seventh at 12:15 PM are also shown as being filled or previously scheduled. Therefore this display or print-out shows the user that he has three available time slots remaining for appointment on that selected day.

In the event that the user is only interested in obtaining at any particular time only a subschedule of time slots that are still available, as for example, in scheduling a new appointment for that selected day, the mode control 91 enables the user to do so. FIG. 4 illustrates a visual display or print-out only of such a subschedule, using the same examples, as in FIG. 3. As shown the display or print-out in FIG. 4 shown only the subschedule with time slots still available at 11:00 AM; 11:15 AM, and at 11:35 AM, respectively, making it much easier for the user to find the best time for a particular purpose. Although a complete schedule totaling seven time slots is used in the examples of FIGS. 3 and 4, it will be appreciated that a much larger number may be selected in actual practice, and that a readout and communication of only the schedule or subschedule alone will make it easier for the user to obtain the information desired.

In a similar manner, the user may be interested only in learning of his schedule of appointments for the given day without the subschedule information. This may be desired where the user wishes to cancel all appointments for that day due to illness or for other reason. This choice may also be made by the user by selection using the mode control 91 in FIG. 2. FIG. 5 shows only the schedule for the selected day or other interval being displayed or printed in chronological order, using the same examples as in FIGS. 3 and 4. As shown, the scheduled time slots are at 10:45 AM; 11:30 AM; 12:00 PM; and 12:15 PM; respectively. Thus the displays or print-out of FIGS. 4 and 5 together, contain the same information as the combined display of FIG. 3 where both the schedule and subschedule are given together. However, it is observed that the separate displays of FIG. 4 or 5 are much easier to read or follow, particularly when a large number of time slots are chosen for the schedules.

Returning to FIG. 2, it is observed that both the time-of-day generator 70 and "NO" generator are pulsed for each time slot that the memory 66 is interrogated and in syncronism with interrogation of the memory 66. However the gates 69 and 74 are alternatively closed to read out the different information depending upon whether or not an appointment has been scheduled for the particular time slot. The speed of reading out the schedule and subschedule information is controlled by the frequency of the clock generator 65, that is made adjustable at 79, as shown. Where a sixty pulse per second clock is chosen, the read-out of the entire schedule and subschedule of 60 time slots is performed in 60 seconds. Faster or slower read-outs are obtained by increasing or decreasing the clock frequency. It will also be appreciated that the digital data from the generators 70 and 71 will be stored in buffer memories, as is now conventional practice, enabling the displays of printing to be conducted in parallel or in series (time sequence). As disclosed in said earlier application above, the T.O.D. generator may employ a conventional integrated watch chip, and the "NO" or other fixed word or words generator may likewise use conventional on the shelf chips. As also earlier disclosed, a reset circuit, of conventional nature, is also provided to terminate the cycling of the clock 65 after each complete schedule and subschedule has been completed, and the schedules have been entered into buffer memory (RAM chips or other-not shown). Operation of the start/stop switching 78, recycles the clock 65 after erasing the buffer memories (not shown)

FIG. 6 shows details of the adjustable mode control circuitry for enabling the user to select either or both of the schedule and/or subschedule information to be read-out and communicated to the user. As shown, each of the T.O.D. generator circuitry 70 and the "NO" generator circuitry 71, as previously described, are connected by gates 69 and 74, respectively, to the adjustable mode controls, to be alternatively transmitted to the display 17, and/or printer 70, and/or the audible annunciator 90. The T.O.D. generator signals pass through multiposition switch or gate 95, and thence through diodes or one way circuits 107 or 206 or 99 to the output devices. In its upper position at 96, the T.O.D. signals for the schedule of appointments are disconnected from the output devices. In its next position 97, the Schedule signals are directed through diode 107 to the bus that can be selectively connected to any one or more of the visual display 17, the printer 70, or the audible annunciator 90, through switches or gates 108, 109, and 110, respectively. In its third position at 98, the T.O.D. schedule signals are directed through diode 99, or other one way gating, to a flasher or matrix generator 105, and thence through diode or one way circuit 106 to the output bus leading to the display, printer, or announcer, as discussed above.

As finally in its lowest position, 205, the switch 95 connects the T.O.D schedule generator through diode 206 to the output bus.

In the uppermost position of switch 95, the schedule information is disabled from the output devices and only the subschedule can be communicated. In the second position at 97, the schedule of appointments can be outputted at any one or more of the output devices 17, 72, or 90 combined with the subschedule of no appointments, in the event that the switch 100 connected to the "NO" generator circuit is also in its second position at 102. In the third position at 98 the T.O.D. schedule of appointment signals are directed through the flasher or matrix circuit to provide a flashing display or printout or a matrix type of printed record of the schedule. Finally, in its last position at 205, the schedule of appointment signals are directed to the output device bus, independently of the subschedule signals.

In a similar manner, the subschedule signals are disabled in the upper position 101 of switch 100, enabling only the schedule signals to be outputted. In its second position at 102, it is connected to the same output bus as the schedule signals but through diode 119, so that both the schedule and subschedule can be outputted together as shown in FIG. 3. In its next position at 103, the subschedule signals are directed through the flasher circuits 105 or matrix before being directed to the selected ones of the output devices. An finally in its lowermost location at 204, the subschedule signals are independently directed to the output bus.

Considering the many choices available to the user, when both the upper switch 95 and lower switch 100 are both set at their second positions 97 and 102, respectively, both the schedule and subschedule of appointments are directed to the output bus, and can be communicated by any one or more of the display screen, the printer 72, or the audible announcer 90. The combined display and or printout is as shown in the example of FIG. 3. Where it is desired to output only the subschedule, as shown in FIG. 4, the upper switch is located in its uppermost position 96, and the lower switch 100 is positioned at any one of its contacts 102, 103, or 204. Similarly where only the schedule is desired to be outputted, the lower switch is located in its off position 101 and the upper switch is positioned at any one of its contacts 97, 98, or 205, to provide a display or print similar to that shown in FIG. 5.

Where both the schedule and subschedule are to be read-out, it may be desired to distinguish one from the other in the display or print-out on paper. This is performed by connecting one of the switches to its third contact, 98 or 100, where that read-out is directed to the flasher circuit 105, and connecting the other switch to its second or fourth contact where it is applied directly to the output bus. In the combined read-out that results, either the schedule or subschedule will therefore be communicated to the user in the form of a flashing display, or matrix display, or print and the other one of the schedule or subschedule will be presented differently as an unprocessed display or print as shown in FIGS. 3, 4, or 5. Either the schedule or subschedule may also be presented by itself in the form of a flashin display or a matrix type, by connecting its associated switch to its third contact 98 or 103, respectively, while connecting the other switch to its uppermost position, or off, at 96 or 101, respectively.

As discussed above, either or both the schedule of appointments or subschedule of no appointments can be communicated to the user by anyone or more of the display screen 17, and/or the printer 72, and/or the audible announcer 90 by connecting the output bus to one or more of these output devices through their associated selector switches 108, 109, and 110. Furthermore either the schedule or subschedule of information can be individually outputted by one or more of the output devices while the other can be outputted by different output devices. For example, it may be desired to provide a hard copy print-out of the schedule and to provide an audible announcement of the subschedule. This can be performed by connecting the schedule switch 95 to its second or fourth position 97 or 205, and closing output device switch 109 or 208, respectively, to connect the printer 72 to the schedule read-out. The subschedule connector switch 100, on the other hand, is connected to its lowermost position 204 and the output device switch 200 is closed to output the subschedule information through the audible announcer 90. Thus, by use of the schedule selector switch or gate 95 and by use of the subschedule selector switch 100; as well as by the use of the output device switches 108 to 110; 200, 202, and 203; and 207 to 209, respectively, either of the schedule or subschedule information can be outputted in various modes either by itself or in combination with the other. Furthermore, either of the schedule or/and subschedule can be provided in a flashing type display, or a matrix type display, or otherwise, as desired, either alone or in combination with the other.

Although the system configuration of FIG. 2 and the adjustable mode selection of FIG. 6 are illustrated in functional block diagram form and generally described, in a manner conventional to those skilled in the art, in general terms of hardware, it will be appreciated that the system can be variously implemented in different forms using conventional on-the-shelf digital microchips, including microprocessors, ROMS, RAMS, buffer memories, gates of varying configuration, and other catalog selected components. Where single lines are shown, as well as the symbols for contact switches, it will be understood that in actual designs multiline busses and electronic gates will be preferably employed as in conventional electronic design practice followed at this time. The continuing improvement and availability of larger area flat screen displays, using LCD's and integrated circuit drivers, presently made available from a number of manufacturers in the United States and Japan, make such displays particularly suitable in implementing the visual display screen 17 in FIGS. 2 and 6 in a small, portable form, such as in a hand held configuration; or slightly larger, such as is presently available in a brief-case size portable computer.

Small and compact thermal array printers, presently in wide usage in hand calculators, portable computers, and elsewhere, are also available from a number of manufacturers including Texas Instruments and Olivetti. Digital voice producing solid state circuit microchips have also been made widely available from National Semiconductor company and a number of other suppliers, including Texas Instruments Inc, within the last few years. These solid state microcircuits are particularly useful in implementing the audio enunciator circuit 90 as disclosed in FIGS. 2 and 6. These circuits respond to digital signals to synthesize spoken words and numbers. The Panasonic company produces a clock that audibly announces the time-of-day at regular intervals during the day. Since all of these elements and components are presently available as catalog items from the manufactures, and in use for various other types of electronic devices, a further description with design information is not considered to be necessary in the present application addressed to those skilled in the art.

As discussed above, the appointment scheduler of the present invention may also be combined with, or made an integral part of, many other electronic devices presently on the market, including pagers, calculators, clocks, clock radios, and computers among others. In such combined applications, many of the components used would be shared with such other devices for other uses. For example, portable computers that are brief-case size or smaller, presently employ large area LCD or other type of solid state display screens, printers, keyboards, buffers, memories, and various other components used in the present invention. These components and the circuits can be time shared, switched alternately, and otherwise shared to provide computing and data processing modes, appointment calendar modes, data base modes, and various other uses that can be made of such versatile electronic equipments.

As disclosed in said earlier patent and application, the rapidly increasing availability of greater capacity of electronic memory in microcircuit size permits a great deal of additional information to be entered and stored pertaining to the schedule of appointments. Not only can the names and addresses of persons involved in the schedule be entered, but the subject matter and other information that is considered to be relevant. Thus the user may first call up the schedule of appointments for a particular day to be reviewed, and then separately interrogate the memory for further details of information concerning any one or more of the listed appointments.

As also earlier disclosed, a series of these units can also be provided for a team of persons, such as plumbers, police, or other groups working together or to service the public, and such units can be provided with telecommunication facilities, or microwave communicating facility to transfer schedule information therebetween or between any one of the units and a central data processor serving as a central source for all such information. For example, when the appointment scheduler of the present invention is made a part of the many functions provided by a portable computer such as is presently available from the Radio Shack TRS Model 100, and others, it may include a built-in modem and programs for communicating information to and from its memory over the telephone line networks, including appointment schedules and subschedules as discussed above.

The flasher and matrix circuit 105 of FIG. 2, are also well known and presently available in microcircuit form from a number of different manufactures. Such microcircuits generally include buffer memories for storing digital words that are serially received, processing circuits for flashing, matrixing, or otherwise modifying the words in the manner desired, and then retransmitting the modified words at the output to the outputting devices, shown in FIG. 6 to include display 17, printer 72, and audible announcer 90. Different colors displays, or other means for distinguishing the schedule of events from the available subschedule may also be used if desired to assist the user in pointing up or distinguishing one class of information from others.

Since these and many other changes may be made by those skilled in the art without departing from the spirit and scope of the present invention, this invention is to be considered as being limited only by the following claims.

I claim:

1. In an electronic time scheduler having a memory and keyboard for enabling a user to enter and store in the memory time schedules of events and appointments, and including read-out means for selectively reading out daily schedules of such events and appointments for selected days, said read-out means selectively controlled by the user to read-out a daily schedule for any selected day of nonscheduled time periods, and said read-out means including mode selection means controlled by the user for selectively reading-out a combined schedule of events and appointments together with said schedule of nonscheduled time periods for that day; the schedule of events and appointments alone; and the schedule of nonscheduled time periods alone.

2. In the time scheduler of claim 1, a visual display for displaying the read out schedule.

3. In the time scheduler of claim 1, a printer for producing a printed record of the read out schedule.

4. In the time scheduler of claim 1, an audible annunciator for audibly announcing the read out schedule.

5. In the time scheduler of claim 1, a selective emphasizer for selectively distinguishing in the read out the schedule of events and appointments from the schedule of no events and appointments.

6. In the time scheduler of claim 1, a message generator, said message generator producing a message indicating that no events or appointments have been made, and said read out means responsive to the absence of an event or appointment for reading out said message in the schedule whenever no event or appointment has been entered at an interrogated time-of-day.

7. In an electronic time scheduler having a keyboard and memory for entering and storing plural time-of-day schedules of appointments and events for different time periods, user controlled read-out means for reading out of said memory the schedules for any desired time period; said user controlled read-out means selectively reading out of said memory subschedules for any selected time period comprising those times-of-day when no appointments or events have been scheduled, and an audible reproducer for audibly annunciating the read-out schedules and subschedules, said audible annunciator controlled by the user to selectively annunciate a combined schedule and subschedule; a selected schedule alone; and a selected subschedule alone.

8. In the time scheduler of claim 7, a visual display for said read out schedules and subschedules.

9. In the time scheduler of claim 7, a printer for printing a record of the read out schedules and subschedules.

10. In the time scheduler of claim 7, a mode selector, a visual display, and a printer, said mode selector enabling said read out to be made audibly, visually, and in print out form as selected by the user.

11. In a digital electronic time scheduler for entering and storing in memory digital data corresponding to a plurality of schedules of appointments and events for different times-of-day for a plurality of days, user controlled read out means for reading out of said memory subschedules for any desired time period comprising a listing of times-of-day when no appointments or events have been made, said user controlled read out means selectively reading out schedules for any selected period, and said user controlled read out selectively reading out both the schedules and subschedules for any selected period, and an output device for communicating the selected schedule, subschedule, and combined schedule and subschedule to the user.

12. In claim 11, said output device including an audible ennunciator responsive to the read out means for audibly announcing the selected subschedules.

13. In claim 11, said output device including a visual display device responsive to the read out means for visually communicating the subschedules to the user.

14. In claim 11, said output device including a printer for providing a print-out of the selected subschedules.

15. In claim 11, said output device including both audible and visual communicating devices, and the time scheduler having user operated selectors for choosing either or both of the communicating device for presenting the selected subschedules to the user.

16. In a digital electronic time scheduler for enabling the entry and storage in memory of digital data corresponding to a plurality of schedules of appointments for a plurality of days, selectively operated circuits under the control of the user for reading-out any of the schedules in memory, said selectively operated circuits alternatively and additionally reading-out subschedules for selected time intervals containing times-of-day periods when no appointments have been previously made for enabling the user to schedule appointments at those available times-of-day, and an output device for communicating the selected schedules and subschedules to the user.

17. In claim 16, said selectively operated read-out circuits under control of the user for reading-out the schedules of appointments for selected interval in addition to or instead of the subschedule of appointments.

18. In claim 16, said output device including both audible and visual communicating devices that are individually selectable by the user to communicate either of the schedule and subschedule audibly and visually.

19. In claim 16, a circuit for distinquishing in the read-out the data related to the schedule of appointments from the data related to the subschedule when no appointments have been made, said circuit for distinguishing data being controllable by the user, in applying the schedule and subschedule to the output device, thereby to enable the schedule and subschedule to be communicated in different fashion to the user.

* * * * *